United States Patent [19]

Fujino

[11] 4,121,062

[45] Oct. 17, 1978

[54] CHANGE-OVER SLIDE SWITCH WITH GROUNDING SPRING MEMBER

[75] Inventor: Hitoshi Fujino, Furukawa, Japan

[73] Assignee: Alps Electric Co., Ltd, Japan

[21] Appl. No.: 792,400

[22] Filed: Apr. 29, 1977

[30] Foreign Application Priority Data

May 1, 1976 [JP] Japan ..... 51-55617[U]

[51] Int. Cl.[2] ..... H01H 15/02

[52] U.S. Cl. ..... 200/16 F; 200/16 D

[58] Field of Search ..... 174/51; 200/16 R, 16 C, 200/16 D, 16 F, 237, 238, 252, 254, 260, 304, 305

[56] References Cited

U.S. PATENT DOCUMENTS 3,271,536 9/1966 Schirk ..... 200/16 C 3,329,778 7/1967 Bedocs ..... 200/16 C 3,987,263 10/1976 Ogasawara ..... 200/305 X

*Primary Examiner*—James R. Scott

*Attorney, Agent, or Firm*—Guy W. Shoup; Gerard F. Dunne

[57] ABSTRACT

A miniature change-over switch is disclosed which comprises a grounding spring member attached to a metal frame and having two arms engaging a camming projection formed on a slider. The camming projection is adapted to move one of the arms by a camming action so as to disconnect it from one of the stationary terminals while at the same time the projection is released from the other of the arms so as to connect the arm to the other of the stationary terminals when the slider is moved to cause a movable contact element to connect a common terminal to the one stationary terminal and to disconnect it from the other stationary terminal.

1 Claim, 7 Drawing Figures

Fig. 5(A)
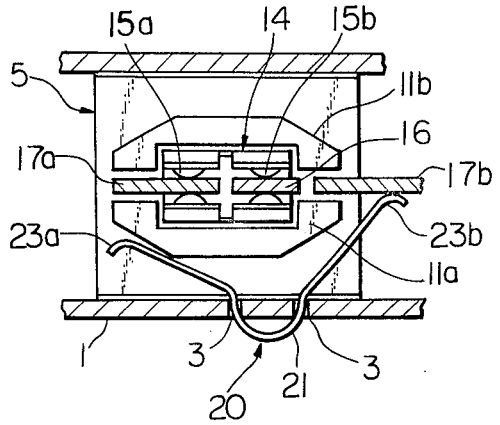
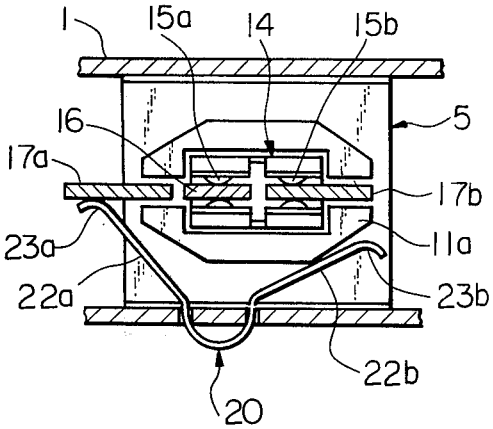
Fig. 5 (B)
Fig. 6
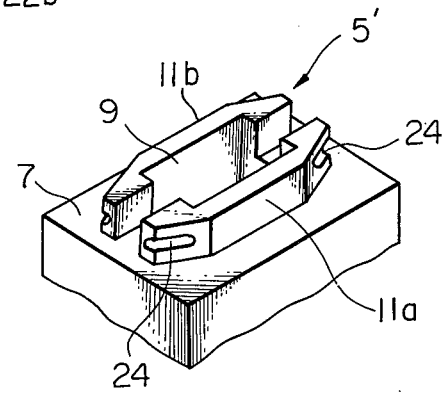

CHANGE-OVER SLIDE SWITCH WITH GROUNDING SPRING MEMBER

BACKGROUND OF THE INVENTION

The present invention relates generally to miniature change-over switches and, more particularly, to change-over switches having a terminal shielding mechanism.

SUMMARY OF THE INVENTION

It is an object of the present invention to provide a miniature change-over switch which will be effective to prevent interference between contact terminals, and is simple in its structure.

Another object of the present invention is to provide a miniature change-over switch which can reduce capacity between contact terminals.

In accordance with the present invention, there is provided a miniature change-over switch comprising a metal frame and an insulating base plate attached to an open end of the frame. A pair of stationary terminals are aligned on the base plate and a common terminal is fixed centrally between the stationary terminals. A slider movable in the frame is formed in its lower surface with a recess and has a camming projection extending from a peripheral portion of the recess. A movable contact element is fixed in the recess to the slider and is movable for selectively connecting the common terminal to one of the stationary terminals. A grounding spring member is attached to the frame and has two arms each engaging the camming projections so that upon movement of slider, the projection moves one of the arms by a camming action so as to disconnect it from one of the stationary terminals while at the same time the projection is released from the other of the arms to connect it to the other of the stationary terminals.

BRIEF DESCRIPTION OF THE DRAWINGS

The present invention will now be described in detail with reference to the following description taken in connection with the accompanying drawings, in which:

FIG. 5(*a*) is a sectional view of the switch taken along the line 5A—5A of FIG. 1;

FIG. 5(*b*) is a view for use in explaining the operation of the switch of the present invention; and FIG. 6 is a view showing a change-over switch in accordance with another embodiment of the present invention.

DETAILED DESCRIPTION OF PREFERRED EMBODIMENTS

Figure 1:
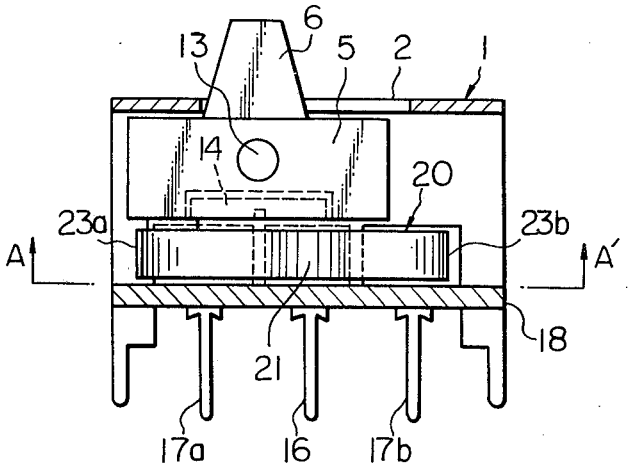
FIG. 1 is a sectional view showing the interior of the essential parts of a change-over switch in accordance with the present invention.
Figure 2:
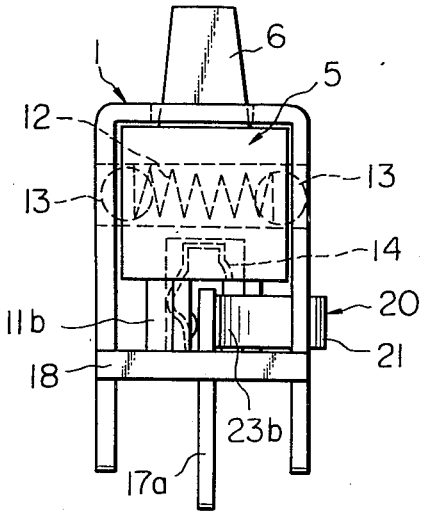
FIG. 2 is an end elevational view of the switch of FIG. 1.
Figure 3:
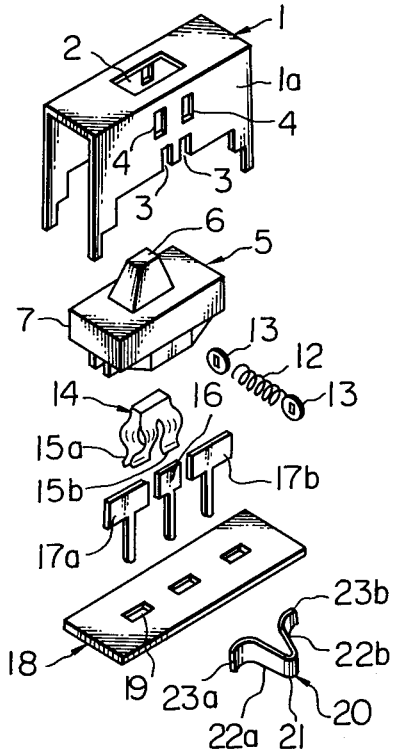
FIG. 3 is a perspective view showing the switch in an exploded form.
Figure 4:
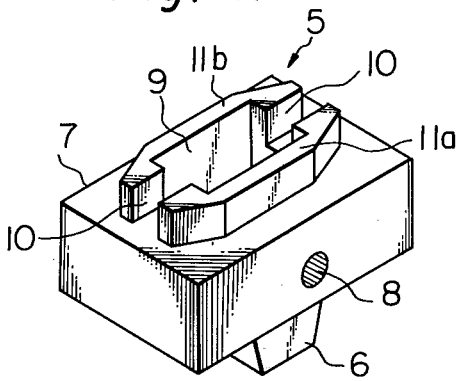
FIG. 4 is a perspective view showing the lower face of a slider used in the switch.

Referring now to the drawings and initially to FIGS. 1 through 4, there is illustrated a change-over switch provided with a grounded shielding mechanism in accordance with the present invention. The switch includes a metal frame 1 having a cross section of a substantially inverted U shape. The metal frame 1 is formed in its upper surface with a rectangular opening 2, and in each side with a pair of notches 3 and 3 and a pair of holes 4 and 4. The metal frame is adapted to be grounded in a known manner. The switch also includes a slider 5 formed of a synthetic resin and provided on its upper surface with a knob 6 and in its body with a hole 8 in which a spring member 12 is disposed. The slider 5 is housed in the metal frame 1 for sliding movement with its knob 6 projecting through the opening 2. A pair of snap-action ball elements 13 and 13 are fixed to the opposite ends of the spring member 12 and are adapted to be engaged in the holes 4 formed on the opposite sides of the frame 1. The slider 5 is also formed in its lower surface 7 with a recess 9 and has projections 11*a* and 11*b* extending in spaced relation from the peripheral portions of the recess 9. A grounding spring member 20 is attached to the frame 1 by having portion 21 of the grounding spring member fitted within the notches 3 and 3. The grounding spring member 20 is formed of a resilient metal plate such as, for example, a phosphor bronze plate. The grounding spring member 20 has arms expanding substantially in a V-shape, each of the arms having its free end 22 curved in a bow to form a contact portion 23. The grounding spring member 20 is attached to the frame 1 so that each arm can engage the same projection. The reference numeral 18 indicates an insulating base plate formed with holes 19 in which a pair of stationary terminals 17*a* and 17*b* and a common terminal 16 are fixed in alignment so that the common terminal 16 is positioned centrally between the stationary terminals 17*a* and 17*b*. Each of the terminals 16, 17*a* and 17*b* is formed integrally with a contact portion and a terminal portion. The base plate 18 is attached to the lower end of the metal frame 1 by a suitable means so that the contact portions of the terminals can extend into the recess 9 of the slider 5. Attached within the recess 9 of the slider 5 is a movable contact element 14 formed of a resilient thin metal plate such as, for example, a silver-plated phosphor bronze plate. The movable contact element 14 has a pair of contact portions 15*a* and 15*b* bent in a clip shape for connecting the common terminal selectively to one of the stationary terminals 17*a* and 17*b*.

The operation of the change-over switch in accordance with this embodiment of the present invention will now be described in connection with FIGS. 1 through 5. When the slider 5 is in its leftmost position, the balls 13 and 13 are in engagement with holes 4 formed in the frame 1. As shown in FIG. 1, the contact portions 15*a* and 15*b* of the movable contact element 14 are in contact with the stationary terminal 17*a* and the common terminal 16, respectively, so that the common terminal 16 is connected electrically to the stationary terminal 17*a*. At this time, the projection 11*a* has moved and expanded the arm 22*a* by a camming action so that the contact portion 23*a* thereof is disconnected from the stationary terminal 17*a*, while the projection 11*a* is released from the arm 22*b* so that the contact portion 23*b* thereof is connected to the stationary terminal 17*b*. Accordingly, the stationary terminal 17*b* is connected through the grounding spring member 20 and the metal frame 1 to ground so that the common terminal 16 and the stationary terminal 17*a* can be shielded from the stationary terminal 17*b*. This is effective to prevent interference between a circuit to the common and stationary terminals 16 and 17*a*, and a circuit to the stationary terminal 17*b*. When the knob 7 is slid in the rightward direction, as shown in the drawing, to move the slider against the latching action of the balls 13 interconnected by spring member 13, the contact portion 15*a* of the movable contact element 14 is disconnected from the stationary terminal 17*a* and is connected to the common terminal 16 while at the same time the contact portion 15*b* is disconnected from the common terminal 16 and is connected to the stationary terminal 17*b*. At this time, the arm portion 22*b* is moved and expanded by the projection 11*a* so that the contact portion 23*b* is disconnected from the stationary terminal 17*b* while the arm portion 22*a* is released from the projection 11*a* and is brought by its resilient force into contact with the stationary terminal 17*a*. Accordingly, the stationary terminal 17*a* is connected to ground. In this condition, as shown in FIG. 5(*b*), the common terminal 16 and the stationary terminal 17*b* are connected and shielded from the stationary terminal 17*a*. When the knob 6 is pushed in the left direction, the slider moves leftwards and returns to the condition as shown in FIG. 5(*a*).

As described above, the change-over switch of the present invention, in which a stationary terminal not connected to the common terminal 16 is always connected to ground, exhibits a superior electrical property and is smaller in size in comparison with the conventional switches in which a play terminal is required to shield one stationary terminal from the other.

While the embodiment shows a change-over switch in which terminals are arranged in a row, two rows of terminals may be arranged to construct a multi-circuit switch with two grounding spring members each engaging a respective projection 11*a* or 11*b* of the slider. Each row of the terminals would then operate similarly to the above-described switch. While the grounding spring member 20 comprises a leaf spring in the above-described embodiment, a line spring may be employed to obtain the same result. In this case, the projection 11 is formed with a recess 24, as shown in FIG. 6, in which the line spring is inserted and placed. If it is undesirable that the stationary contact is to be grounded, an insulating film may be attached to the inner side of the grounding spring member 20. This arrangement also serves to reduce capacity between the terminals when used in a high-frequency circuit.

While the present invention has been shown and described in connection with slide switches, it is to be understood that the present invention is applicable to pushbutton switches, lever switches, or the like.

While the present invention has been particularly shown and described with reference to preferred embodiments thereof, it will be understood by those skilled in the art that the foregoing and other changes in form and details may be made therein without departing from the spirit and scope of the invention.

What is claimed is:

1. A change-over switch comprising a metal frame having an open end;

a base plate attached to the open end of said frame and comprised of an electrically insulating material;

a row of terminals aligned on said base plate, said row including two stationary terminals and a common terminal therebetween;

a slider comprised of an electrically insulating material and received slidably within said frame, said slider having a recess formed in its lower portion and projections extending from peripheral portions of said recess;

a movable contact fixed within said recess, said movable contact being adapted to electrically connect said common terminal alternatively with one or the other of said stationary terminals upon sliding movement of said slider; and means connected to said frame for grounding the stationary terminal not connected electrically to said common terminal, said means including a grounding spring member adapted to be connected to ground and having two arms each adapted to engage a respective stationary terminal, whereby upon sliding movement of said slider to connect a selected stationary terminal to said common terminal, said projection moves between said selected stationary terminal and the arm engaged thereto for isolating said selected terminal from ground.

* * * * *